United States Patent [19]

Bonne

[11] Patent Number: 4,568,266

[45] Date of Patent: Feb. 4, 1986

[54] FUEL-TO-AIR RATIO CONTROL FOR COMBUSTION SYSTEMS

[75] Inventor: Ulrich Bonne, Hopkins, Minn.

[73] Assignee: Honeywell Inc., Minneapolis, Minn.

[21] Appl. No.: 664,107

[22] Filed: Oct. 24, 1984

Related U.S. Application Data

[63] Continuation-in-part of Ser. No. 542,245, Oct. 14, 1983, abandoned.

[51] Int. Cl.[4] ..... F23N 5/18

[52] U.S. Cl. ..... 431/76; 431/12; 431/18

[58] Field of Search ..... 431/12, 18, 76; 236/15 BD, 15 BG, 15 E; 432/37; 110/186, 191

[56] References Cited

U.S. PATENT DOCUMENTS

| | | | |
|---|---|---|---|
| 3,947,217 | 3/1976 | Graat et al. | 431/12 |
| 4,033,712 | 7/1977 | Morton | 431/12 X |
| 4,162,889 | 7/1979 | Shigemura | 431/76 |
| 4,238,185 | 12/1980 | Watson | 431/76 |
| 4,260,363 | 4/1981 | Cratin | 431/76 |
| 4,348,169 | 9/1982 | Swithenbank et al. | 431/12 X |

*Primary Examiner*—Margaret A. Focarino
*Attorney, Agent, or Firm*—John P. Sumner

[57] ABSTRACT

Disclosed is a system for reaching and maintaining a desired fuel-to-air ratio in a combustion system. The system comprises apparatus for monitoring information related to fuel-to-air ratio. The system further comprises apparatus for waiting to adjust a set point of the fuel-to-air ratio until after the passage of a predetermined period of time following the onset of a particular flame-on period. The apparatus for waiting comprises apparatus for waiting again to adjust the set point of the fuel-to-air ratio as required only after the occurrence of either of the two following events, whichever occurs first: the passage of a predetermined period of time after the previous adjustment of fuel-to-air ratio; or the passage of a predetermined period of time following the onset of the flame-on period occurring subsequent to the flame-on period in which the fuel-to-air ratio was last adjusted. The apparatus for waiting again comprises apparatus for holding the set point established by the prior adjustment during flame-off time and during the time between adjustments so that flame-on time subsequent to the prior adjustment uses the prior set point, the apparatus for waiting again further comprising apparatus for repeating the steps carried out by the apparatus for waiting again as required to substantially reach and maintain the desired fuel-to-air ratio.

6 Claims, 1 Drawing Figure

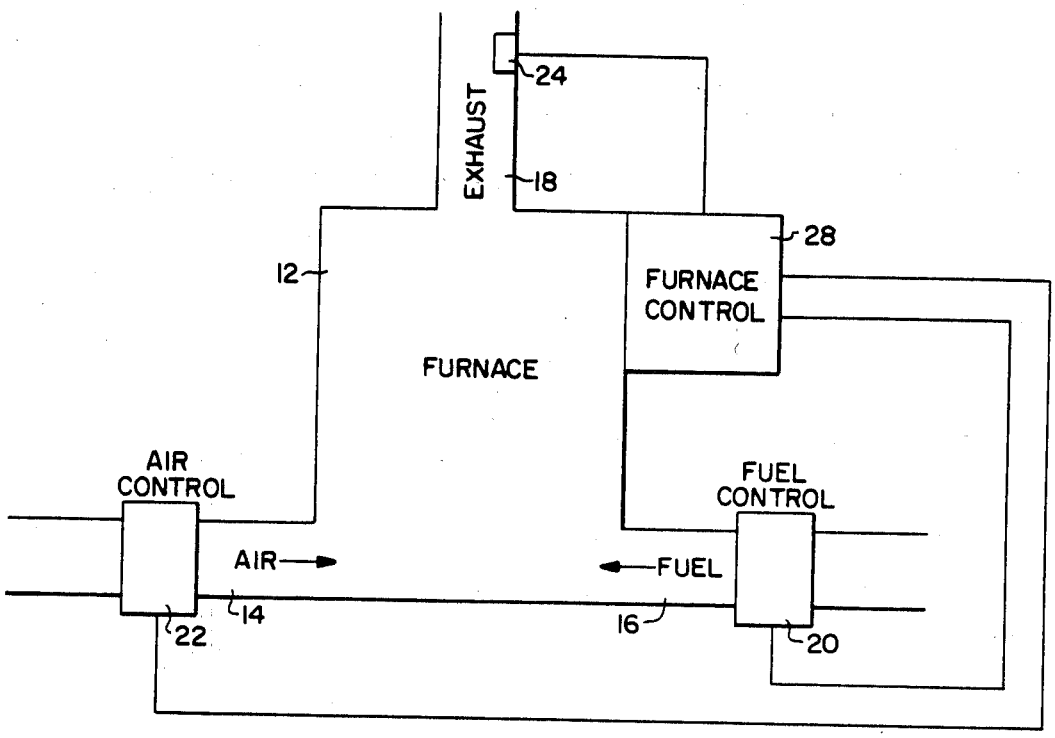
EXHAUST
24
18
28
12
FURNACE
CONTROL
FURNACE
AIR
CONTROL
FUEL
CONTROL
AIR
FUEL
14
16
22
20

FUEL-TO-AIR RATIO CONTROL FOR COMBUSTION SYSTEMS

BACKGROUND OF THE INVENTION

This application is a continuation-in-part application of application Ser. No. 542,245 filed 10/14/83 and now abandoned.

High energy costs require that energy efficiency be increased. For combustion systems, this means reducing the excess combustion air which translates into flue gas carbon dioxide increases, oxygen decreases, or moisture content increases.

Implementation of such schemes have long been hampered in many systems due to combustion gas flow lag time and the response time of available sampling and sensor systems. For such prior art systems, adjusting fuel-to-air ratio on a continuous basis causes the system to undergo hunting, which is the undesirable process of over or under correcting brought about by making adjustments based on incorrect information. The present invention eliminates this dynamic problem.

SUMMARY OF THE INVENTION

The present invention comprises a system for reaching and maintaining a desired fuel-to-air ratio in a combustion system. The system comprises apparatus for monitoring information related to fuel-to-air ratio. The system further comprises apparatus for waiting to adjust a set point of the fuel-to-air ratio until after the passage of a predetermined period of time following the onset of a particular flame-on period. The apparatus for waiting comprises apparatus for waiting again to adjust the set point of the fuel-to-air ratio as required only after the occurrence of either of the two following events, whichever occurs first:

the passage of a predetermined period of time after the previous adjustment of fuel-to-air ratio; or the passage of a predetermined period of time following the onset of the flame-on period occurring subsequent to the flame-on period in which the fuel-to-air ratio was last adjusted.

The apparatus for waiting again comprises apparatus for holding the set point established by the prior adjustment during flame-off time and during the time between adjustments so that flame-on time subsequent to the prior adjustment uses the prior set point, the apparatus for waiting again further comprising apparatus for repeating the steps carried out by the apparatus for waiting again as required to substantially reach and maintain the desired fuel-to-air ratio.

BRIEF DESCRIPTION OF THE DRAWINGS

The FIGURE illustrates a system compatible with the present invention.

DESCRIPTION OF THE PREFERRED EMBODIMENTS

The FIGURE illustrates a furnace 12 having an air input 14, a fuel input 16, and an exhaust output 18. Although air input 14 and fuel input 16 are shown as separate inputs in the FIGURE for clarity, it is understood that they are typically placed in close proximity to provide appropriate mixing of the fuel and the air. Fuel flow rate is controlled by control 20 which may comprise conventional main and modulating valves controlled by conventional valve actuators. Conventional air flow control 22 controls the flow rate of air to be combined with fuel for the combustion process. The products of combustion in exhaust 18 may be monitored by sensor 24 in order to determine the approximate excess oxygen level, i.e.; fuel-to-air ratio, within furnace 12. Sensor 24 may comprise a conventional oxygen, carbon dioxide, or water vapor sensor.

Controls 20 and 22 are coupled to a furnace control 28 which may comprise a conventional industrial programmer and a microcomputer or a conventional general purpose digital computer. Control 28 is also coupled to sensor 24 in order to monitor data related to the fuel-to-air ratio of the combustion process.

Furnace control 28 also communicates with apparatus to determine that a flame is burning. Such apparatus may comprise sensor 24 and/or may comprise conventional devices (not shown) such as a flame (ionization) rod, an optical sensor, a temperature sensor, or other device.

In accordance with the present invention, sensor 24 transmits a signal related to fuel-to-air ratio to control 28 for processing (e.g. comparison to a set point) and storage. Control 28 typically waits to monitor sensor 24 and to adjust the fuel-to-air ratio until the passage of a predetermined period of time following the onset of the first flame-on period. This waiting period provides time for the signal of sensor 24 to stabilize as the fuel-to-air ratio of the combustion product stabilizes. This stabilization occurs both after an initial system start-up and after an adjustment to fuel-to-air ratio. Although the present system typically waits the predetermined period of time before monitoring a signal from sensor 24, the system may also be implemented to monitor sensor 24 on a continuous basis and to use the information from sensor 24 only at predetermined times in accordance with the present invention.

If an adjustment to fuel-to-air ratio is required, control 28 then generates a signal as required to trim an actuator within fuel control 20 or to adjust air flow rate by air control 22, or both, in order to achieve a new fuel-to-air ratio. Control 28 then waits again to monitor the fuel-to-air ratio and/or then adjusts the fuel-to-air ratio as required based on a signal from sensor 24 only after the occurrence of either of the following events, whichever occurs first:

the passage of a predetermined period of time after the previous adjustment of fuel-to-air ratio; or the passage of a predetermined period of time following the onset of the flame-on period occurring subsequent to the flame-on period in which the fuel-to-air ratio was last adjusted.

Fuel control 28 holds the set point established by the prior adjustment during flame-off time and during the time between adjustments so that flame-on time subsequent to the prior adjustment uses the prior set point. Control 28 then waits again and monitors and/or adjusts the fuel-to-air ratio as required only upon the occurrence of either of the two previously mentioned events, whichever occurs first. This is repeated as required in order to substantially reach and maintain the desired fuel-to-air ratio.

The predetermined period of time which the system waits before the first fuel-to-air ratio adjustment is made may or may not be the same predetermined period of time that is waited for subsequent adjustment. Either of these two predetermined periods of time vary with system size and type but is typically on the order of one minute.

The embodiments of the invention in which an exclusive property or right is claimed are defined as follows:

1. Apparatus for reaching and maintaining a desired fuel-to-air ratio in a combustion system, comprising:

means for monitoring information related to fuel-to-air ratio;

means for waiting to adjust a set point of the fuel-to-air ratio until after the passage of a predetermined period of time following the onset of a particular flame-on period;

the means for waiting comprising means for waiting again to adjust the set point of the fuel-to-air ratio as required only after the occurrence of either of the following events, whichever occurs first:

the passage of a predetermined period of time after the previous adjustment of fuel-to-air ratio; or the passage of a predetermined period of time following the onset of the flame-on period occurring subsequent to the flame-on period in which the fuel-to-air ratio was last adjusted;

the means for waiting again comprising means for holding the set point established by the prior adjustment during flame-off time and during the time between adjustments so that flame-on time subsequent to the prior adjustment uses the prior set point, the means for waiting again further comprising means for repeating the steps performed by the means for waiting again as required to substantially reach and maintain the desired fuel-to-air ratio.

2. The apparatus of claim 1 wherein the means for monitoring comprises an oxygen sensor.

3. The apparatus of claim 1 wherein the means for monitoring comprises a carbon dioxide sensor.

4. The apparatus of claim 1 wherein the means for monitoring comprises a sensor for measuring a moisture content.

5. The apparatus of claim 1 wherein the means for waiting comprises a fuel control.

6. The apparatus of claim 1 wherein the means for waiting comprises an air flow control.

* * * * *